US005083845A

United States Patent [19]

Sparks et al.

[11] Patent Number: 5,083,845

[45] Date of Patent: Jan. 28, 1992

[54] APPLIANCE MANUFACTURING AND TRANSFORT FIXTURE

[75] Inventors: Gene A. Sparks, St. Joseph, Mich.; Paul R. Staun, Scott Township, Vanderburgh County, Ind.; Steve A. Flam, Kalamazoo, Mich.

[73] Assignee: Whirlpool Corporation, Benton Harbor, Mich.

[21] Appl. No.: 532,315

[22] Filed: Jun. 1, 1990

[51] Int. Cl.[5] ..... A47B 77/06

[52] U.S. Cl. ..... 312/228; 248/581; 248/561; 248/613; 206/320

[58] Field of Search ..... 248/581, 603, 610, 613, 248/561; 312/209; 206/320

[56] References Cited

U.S. PATENT DOCUMENTS

| | | | |
|---|---|---|---|
| 2,647,591 | 8/1953 | Young | 248/610 X |
| 3,471,116 | 10/1969 | DeCherrie . | |
| 3,902,692 | 9/1975 | Skinner . | |
| 3,934,805 | 1/1976 | Elaschuk . | |
| 4,146,205 | 3/1979 | Skinner . | |
| 4,577,828 | 3/1986 | Drucker et al. . | |

FOREIGN PATENT DOCUMENTS

| | | | |
|---|---|---|---|
| 53-35302 | 9/1978 | Japan . | |
| 133192 | 11/1978 | Japan | 206/320 |

*Primary Examiner*—Joseph Falk

[57] ABSTRACT

A fixture for appliance manufacturing and transport of the assembled appliance supports vertically movable components of the appliance at differing elevations during manufacturing and continues to at least partially support the components during the transport after assembly. A particular use of the fixture is in the manufacture of a washing machine which has a suspended wash tub and drive assembly and an outer cabinet. The fixture is composed of a main support and a cabinet support with the main support being vertically movable relative to the cabinet support, yet held by the cabinet support in a fixed horizontal position. The wash tub and drive assembly is supported during use by a suspension system connected between the wash tub and cabinet and with the use of the fixture, a portion of the weight of the wash tub is supported at all times during the assembly process and during shipping, relieving the cabinet from bearing that weight. Further, with the tub support being movable relative to the cabinet support in a vertical sense, the wash tub can be elevated relative to the cabinet for purposes of attaching the suspension system between the tub and cabinet thus greatly facilitating the manufacturing process.

26 Claims, 6 Drawing Sheets

APPLIANCE MANUFACTURING AND TRANSFORT FIXTURE

BACKGROUND OF THE INVENTION

The present invention relates to a fixture for use in manufacturing and transporting an appliance and to a method of manufacturing an appliance with such a fixture. More particularly, the invention relates to a manufacturing and transport fixture for use with an appliance having an outer cabinet and an inner suspended member having a resilient suspension system between the suspended member and the cabinet for transferring the weight of the suspended member to the cabinet.

In the manufacturing of appliances, oftentimes fixtures are utilized for carrying various components of the appliance during the assembly process which may be carried out with the use of a conveyor system. Usually the fixtures are strictly utilized in the manufacturing process and at some point during the manufacturing process, the fixtures are removed from the assembled or partially assembled appliance and are reused again in manufacturing other appliances. In some instances, such as in U.S. Pat. No. 4,146,205, a fixture may be utilized both for assembly in an assembly as well as for shipping purposes. In other instances, such as in U.S. Pat. Nos. 3,934,805 and 4,577,828, a base of an appliance may be utilized to hold other components during assembly of the appliance, to be used during shipping and also after the appliance is installed.

A multiple component fixture utilized during both assembly and shipping is disclosed in U.S. Pat. No. 3,471,116 which comprises three blocks of expanded polystyrene foam which are utilized to support both ends in a central portion of a cabinet such as a console television cabinet during assembly and shipping. The polystyrene blocks on either end contain recesses for receiving components of the cabinet, such as legs, while the central block is frictionally captured between a pair of braces on the under surface of the central portion of the cabinet.

SUMMARY OF THE INVENTION

The present invention is primarily directed to a combined manufacturing and shipping fixture for an appliance with an inner portion suspended from the cabinet through a suspension means.

The present invention finds particular utility in assembling an appliance of the type that has an exterior cabinet with an interior assembly that is connected to the cabinet by means of a suspension system such as a washing machine which has an outer cabinet and a tub assembly which is connected to the cabinet by means of a rod and ball suspension system. In such an arrangement, the fixture would consist of two distinct portions, each constructed entirely of expanded polystyrene (EPS).

The first portion of the fixture is a tub or main support which is attached to the bottom of the tub assembly to carry at least a portion of the weight of the tub assembly. The tub support consists of a raised platform with a recessed area for receiving and frictionally engaging the bottom portion of the tub assembly. A number of sidewalls depending from the platform support the platform. The tub support is cut away in the vicinity of various mechanical components to permit test operation of the washer on the assembly line with the tub support attached. A drain hole is provided at the bottom of the recessed area to drain liquid from the fixture, which may result from operation of the washer during testing.

The second portion of the fixture is the cabinet support, which consists of two identical halves. The halves of the cabinet supports are of appropriate size and shape to be butted up tightly against opposite sides of the tub support, although permitting the tub support to move vertically relative to the cabinet supports as described below. Each half of the cabinet support includes groove for receiving the bottom edge of the cabinet, and an opening for partially surrounding the tub support.

During the manufacturing process of a washer of the type described above, the tub assembly is assembled in an inverted orientation, and the tub support is applied to the upward-facing bottom of the tub assembly. The suspension rods are also connected to the outside of the tub assembly. The tub assembly is then turned over to an upright orientation so that the tub assembly rests on the tub support.

The two halves of the cabinet support are then placed on opposite sides of the tub support and the cabinet is then lowered over the tub assembly to rest on the cabinet supports. At this point, the upper ends of the suspension rods are not yet connected to the cabinet.

To complete the connection of the suspension system to the cabinet, the tub assembly and the tub support are raised vertically by a machine in the assembly line, relative to the cabinet and cabinet support. While the tub assembly is being raised, the top ends of the suspension rods are inserted through holes and sockets at each of the corners of the cabinet. After the rods are inserted through the holes, suspension balls are attached to the top of each rod. The tub assembly is then lowered relative to the cabinet so that the balls are seated in the sockets.

The tub support is designed to support the tub assembly at a height above the predetermined rest height of the tub assembly without the support installed. In this manner, the suspension system and cabinet are at least partially unloaded of the weight of the tub assembly, and the tub support carries the weight instead. This prevents damage to the suspension balls and rods and to the cabinet which may result from carrying the weight of the tub assembly during transport.

Since the tub and cabinet supports are located below the tub assembly, they absorb vertically-directed shocks which would otherwise be transferred to the washer. Furthermore, the cabinet supports are in close contact with the tub support to prevent any horizontal displacement between the tub assembly and cabinet. This prevents potentially damaging contact between the tub assembly and cabinet during transport.

The fixture is compatible with either carton or shrink-wrap external packaging materials. When the washer is unpacked at its final destination, the fixture is removed and may be discarded along with the rest of the packaging materials.

The tub support is designed to provide a stable base for the tub assembly as it travels on the assembly line conveyor. The dimensions of the tub support along the axis parallel to the direction of motion of the conveyor are crucial to prevent tipping of the tub assembly in response to acceleration or deceleration of the conveyor. Thus, the present invention provides a fixture for use during the manufacturing function and assembly process which permits vertical displacement of the suspended portion of the appliance relative to the outer cabinet to permit installation of the suspension system. The fixture also permits operation of the appliance with the fixture installed including the draining of any leaked fluid from the appliance if the appliance is of the type to utilize a fluid during operation. During the shipping process, the transport functions of the fixture include supporting the suspended portion of the appliance above its normal suspended height to unload the cabinet and suspension system and also to prevent horizontal displacement between the suspended portion of the appliance and the cabinet to prevent contact therebetween and to absorb vertically directed shocks which might harm the appliance. After shipping, the fixture is discarded with the remainder of the shipping materials.

Numerous advantages are associated with the use of the disclosed fixture.

The fixture is used throughout the entire manufacturing process, permitting the use of a simplified conveyor system, and avoiding the need to transfer the appliance to a different fixture.

The fixture is retained solely by friction, avoiding the additional cost of fasteners, as well as the time and labor associated with the installation of fasteners. Additionally, the light weight construction of the fixture makes manual installation feasible.

The fixture is included with the shipped appliance, avoiding the resources necessary to remove a fixture at the end of the manufacturing process.

The provision of separate supports for the suspended portion of the appliance and the cabinet permits vertical displacement of the suspended portion and its support relative to the cabinet for connection of the suspension system to the cabinet. The manufacturing process would be significantly more complicated if this were not possible.

The configuration of the fixture permits testing of the appliance with the fixture installed.

The EPS construction of the fixture is especially effective at absorbing shocks which may damage the hung suspension system.

The fixture is compatible with either conventional carton-type external packaging or with shrink-wrap packaging materials.

DESCRIPTION OF THE PREFERRED EMBODIMENTS

Figure 1:
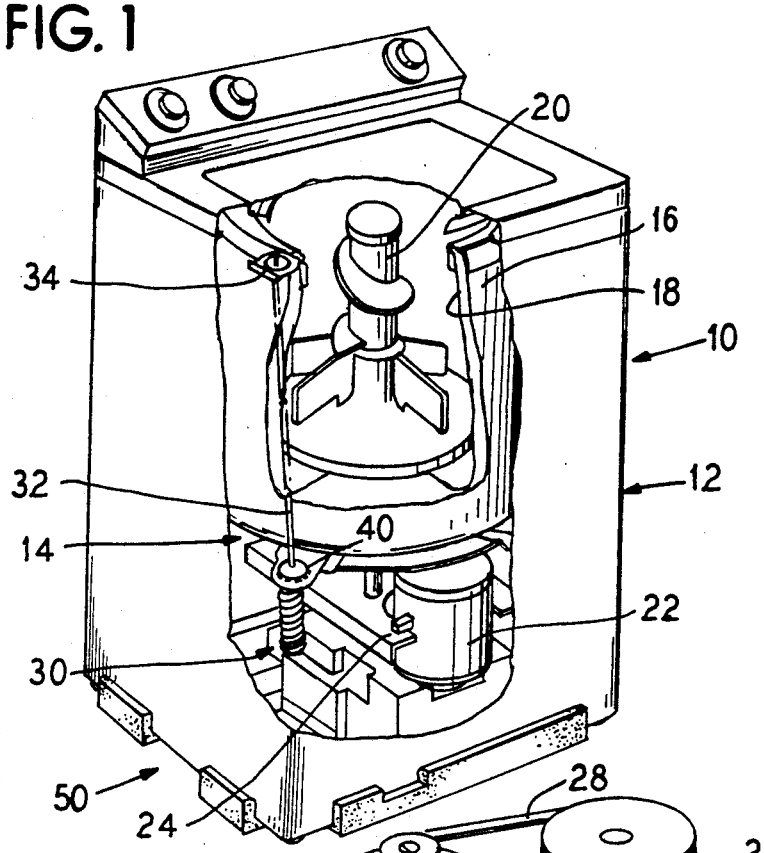
FIG. 1 is a perspective view of an automatic washer in which the present invention can be utilized.

In FIG. 1 there is illustrated a washing machine generally at 10 in which a pre-programmed series of agitating, spinning and rinsing steps may be undertaken. The washing machine has an exterior cabinet 12 being generally cubic in shape and generally surrounding an interior wash tub and drive assembly 14. The wash tub and drive assembly is comprised of an outer imperforate wash tub 16, a coaxially mounted wash basket 18 and a coaxially mounted vertical axis agitator 20. The agitator 20 and basket 18 are selectively driven by an electric motor 22 which is carried on a mounting plate 24 supported beneath the wash tub 16. The motor 22 is connected to the agitator 20 and basket 18 by means of an appropriate transmission 26 which may include a drive belt 28. Alternatively, the motor 22 may be connected directly to the clutch and gearing mechanism 26 (FIG. 2).

The tub and drive assembly 14 is supported by means of a suspension system 30 which may include suspension rods 32 captured at a top end 34 by the cabinet 12 and at a bottom end 36 connected through a spring 38 to an arm 40 of the mounting plate 24.

As also seen in FIG. 1, there is a support fixture 50 engaging and supporting the tub and drive assembly 14 as well as the cabinet 12.

Figure 2:
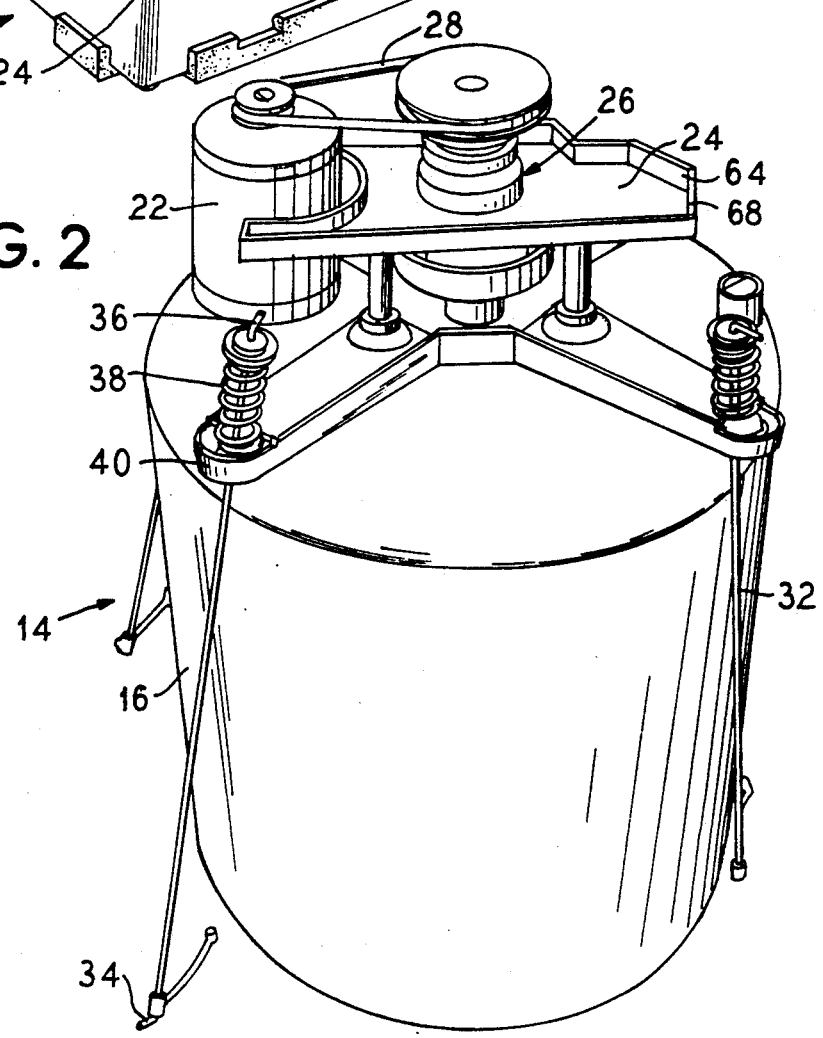
FIG. 2 is a view of the wash tub and drive assembly of the automatic washer of FIG. 1 shown in an inverted position prior to assembling the main support of the present invention.

In the assembly of the washing machine illustrated in FIG. 1 the wash tub and drive assembly 14 is first subassembled with the tub in an inverted position such as that shown in FIG. 2. This permits the manufacturing personnel to attach and secure the various sub-components of the drive system and suspension system to the wash tub assembly. Once the components of the wash tub and drive assembly 14 are fully assembled, a main or tub support member 60 which forms a portion of the fixture 50 is frictionally attached to the wash tub and drive assembly 14 by engaging with the base plate 24. Preferably the main support member is constructed of a semi-rigid shock absorbing material such as expanded polystyrene.

Figure 9:
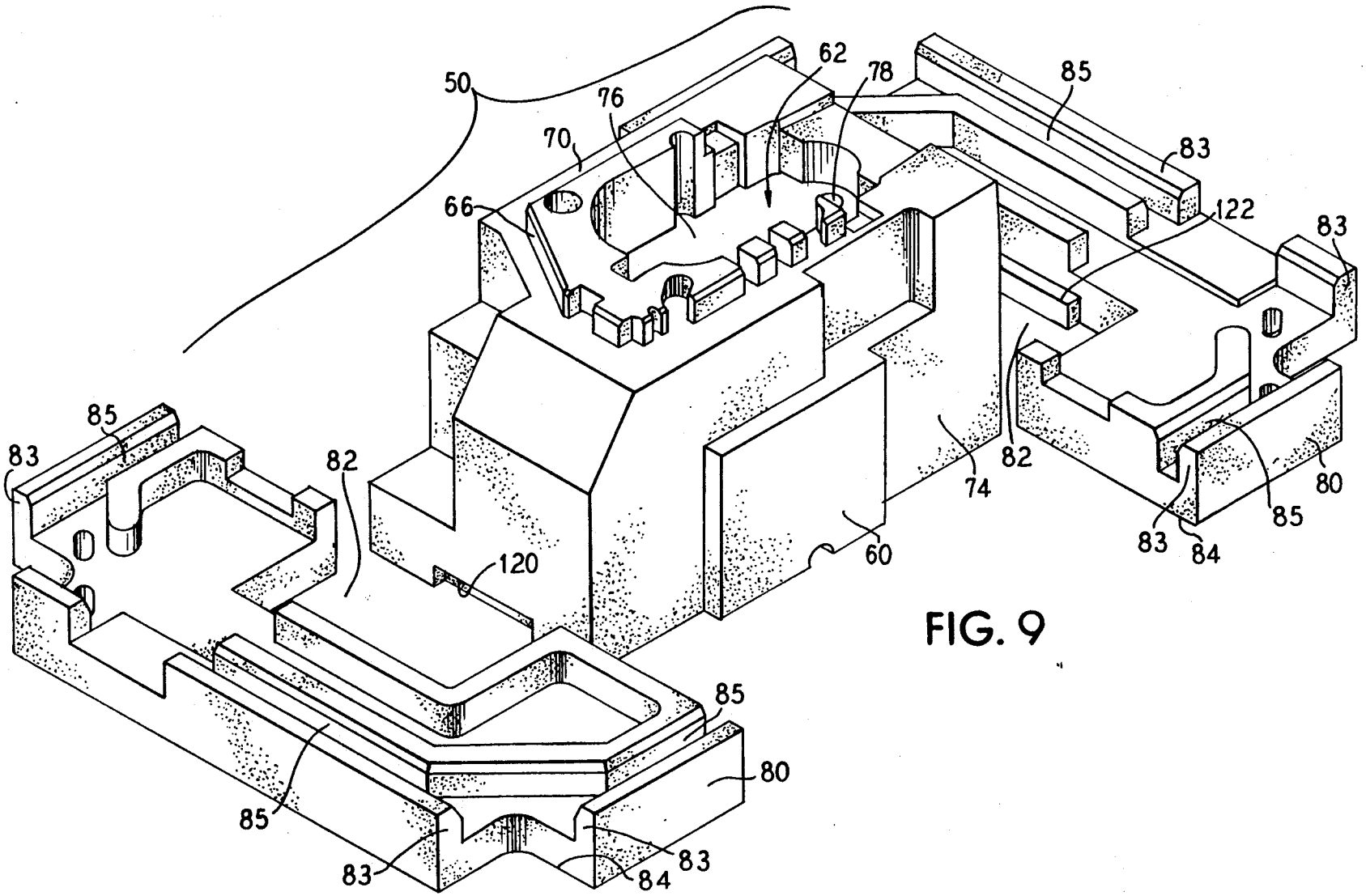
FIG. 9 is a perspective exploded view of the main support and cabinet supports.

The tub support 60 is shown in better detail in FIG. 9 where it is seen that there is a central upper opening or recess 62 which receives portions of the motor 22, drive belt 28 and clutch member 26. The support plate 24 has a vertically extending side wall 64 which surrounds and engages a vertical wall 66 of the tub support 60. A terminal edge 68 of the support plate wall 64 engages a horizontal surface or platform 70 of the tub support 60 below the vertical wall 66 which is engaged by the support plate 24. When the tub support 60 is mated onto the wash tub and drive assembly 14, frictional forces will retain the main support 60 in place without the use of additional fasteners.

Figure 8:
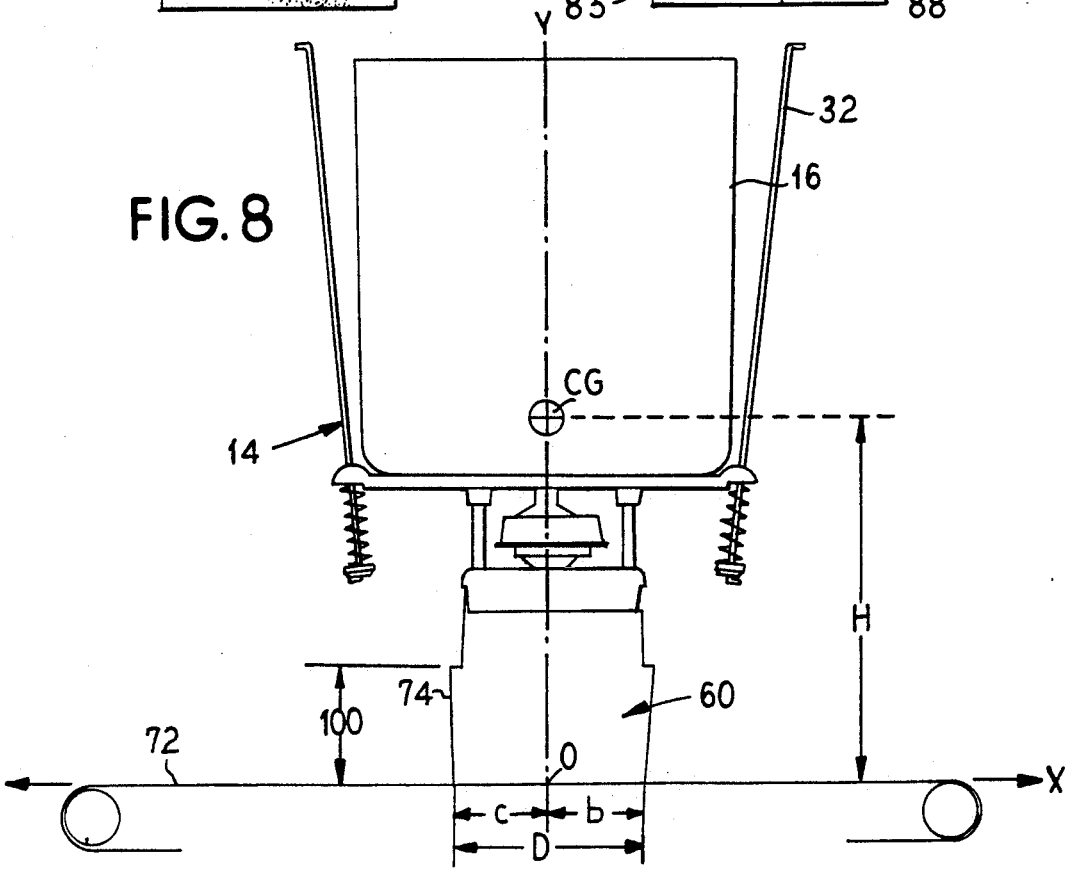
FIG. 8 is a side schematic view of the wash tub supported on the main support during an early stage of the manufacturing operation.

After the tub support 60 has been thus secured to the wash tub and drive assembly 14 the entire assembly is inverted to an upright position and is placed on a moving conveyor belt and will thus have the appearance as shown in FIG. 8. Dimensions of the main support 60 are critical during the manufacturing process. For example, in referring to FIG. 8, the assembly of the wash tub and drive assembly 14 and the tub support 60 is transported on a conveyor belt 72 and a coordinate system consisting of a perpendicular horizontal X axis and a vertical Y axis which intersect at an origin O. The X axis which is shown as running along the length of the conveyor has both a positive direction and a negative direction depending upon whether the assembly is moving to the left or right as seen in FIG. 8. During the transport of the assembly 14, 60 by the conveyor 72, starting and stopping of the conveyor will result in an acceleration of the conveyor. Since a center of gravity CG of the overall assembly 14, 60 is positioned at a height H on the Y axis above the origin, the distance c and b, being the extent of the main base 60 along the positive and negative X axis must be sufficiently large so as to prevent a tipping of the assembly 14, 60. Preferably the main support 60 has an identical positive and negative extent along the X axis such that $b=c$ and therefore the overall extent of the base along the X axis is identified as D which equals $b+c$. When the conveyor has a maximum acceleration a in the positive or negative direction of the X axis, and where the appliance has a mass M and a weight W defined by $W=M * G$, where G is the acceleration due to gravity, then the dimension D must correspond to the following formula to prevent tipping of the appliance in response to the maximum acceleration of the conveyor: $D>=(M\times A\times H\times 2)/W$. If dimensions b and c are not equal, then D would no longer be defined as $b+c$, but would rather be defined as 2 times the smaller of b or c.

Thus, by modifying A, H and D, the assembly can be prevented from tipping during the conveying process.

Figure 7:
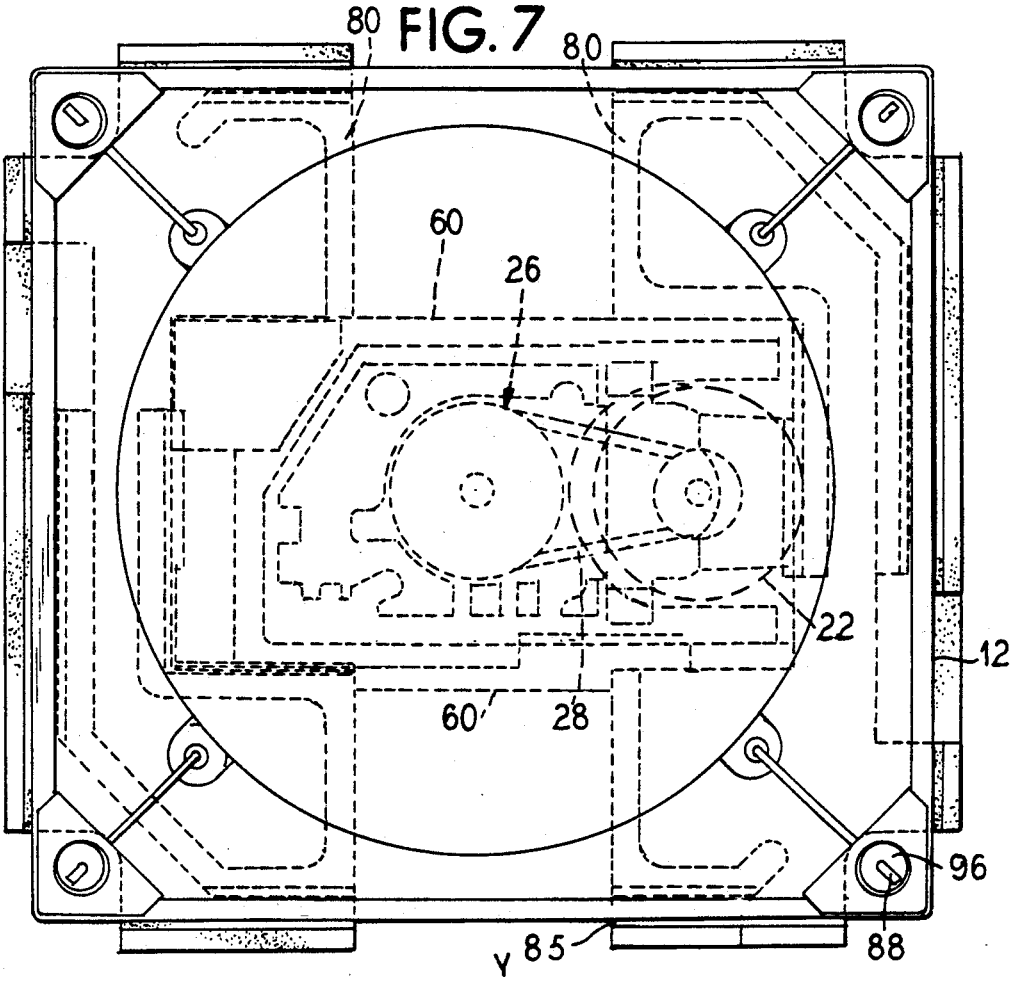
FIG. 7 is a plan view of the washing machine of FIG. 1 supported on the main and cabinet supports.

The recess 62 in the main support 60 is configured so as to be relieved in any areas where there is a movable portion of the wash basket and support assembly 14. Thus, the motor, drive pulleys and drive belt associated with the motor and other moving components are all free to move when the tub support 60 is engaged onto the wash tub and drive assembly 14. This clearance is illustrated in phantom in FIG. 7.

The platform 70 is supported by a number of sidewalls 74 and the recess 62 has a bottom wall 76 with an aperture 78 therethrough to permit drainage of any fluid accumulated in the recess, such as during testing of the washer during the assembly process. The relieved areas of the recess 62 permit movement of various moving components and thus operation of the washer on the assembly line.

A second component of the fixture 50 is a pair of cabinet support halves 80. Each cabinet support half is symmetrical and contains a center recessed area or aperture 82 for laterally receiving the main support 60 in sandwiched fashion. The cabinet support members 80 have a peripheral flange 83 at a base surface 84 with a groove 85 extending around portions of the flange 83 for frictionally receiving a bottom edge 86 of the washer cabinet. The cabinet support members are also preferably constructed of a semi-rigid shock absorbing material such as expanded polystyrene.

Figure 3:
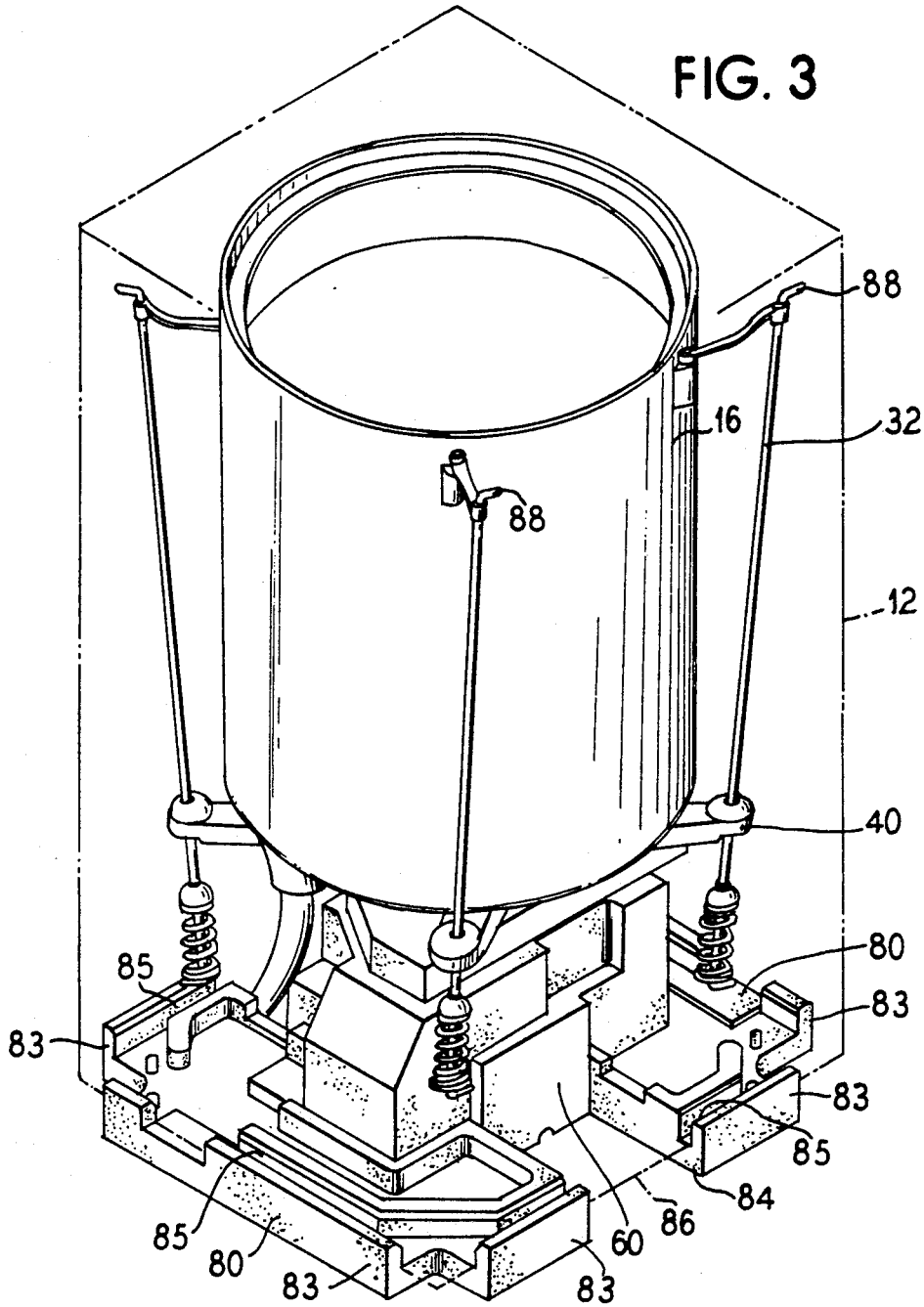
FIG. 3 is a perspective of the wash tub and drive assembly being supported on a main support along with adjacent cabinet supports with the cabinet shown in phantom.
Figure 4:
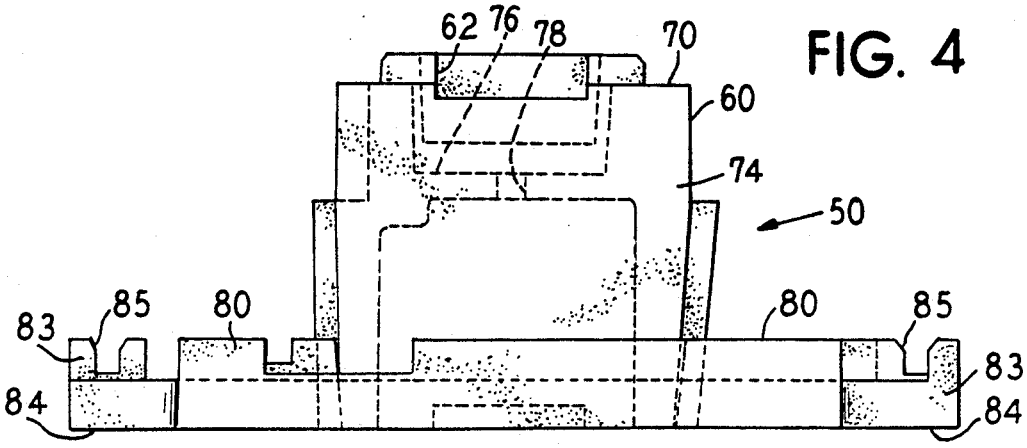
FIG. 4 is a side elevational view of the main support and cabinet supports in assembly.
Figure 5:
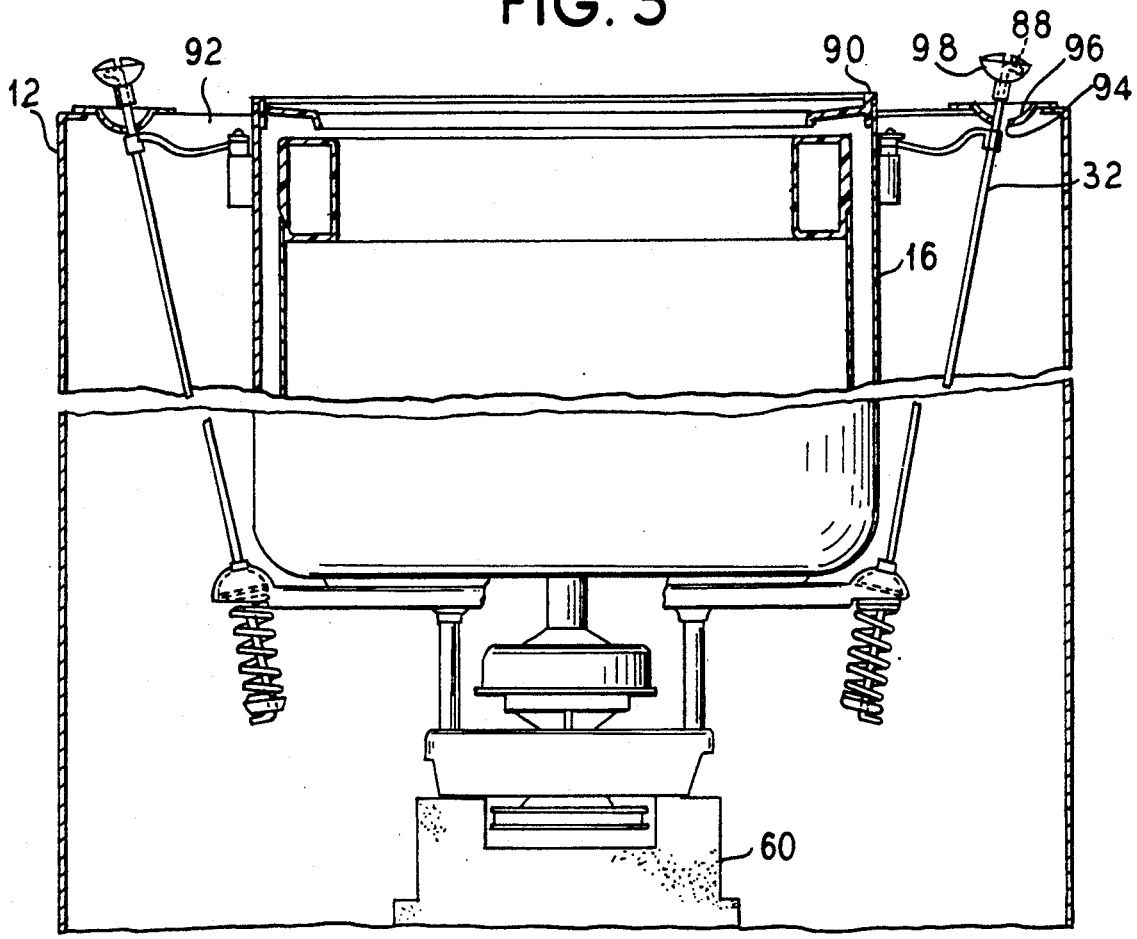
FIG. 5 is a partial side sectional view of the wash tub, drive assembly and main support in an elevated position to permit assembly of the suspension system from the drive tub to the cabinet.
Figure 6:
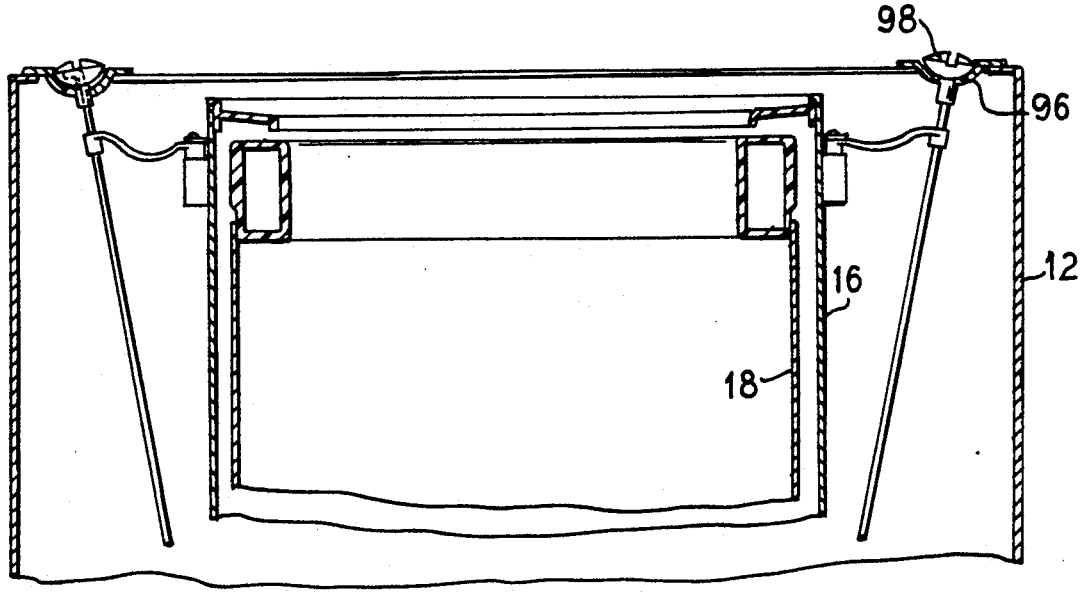
FIG. 6 is a partial side sectional view of the wash basket lowered into a position supported in part by the main support.
Figure 10:
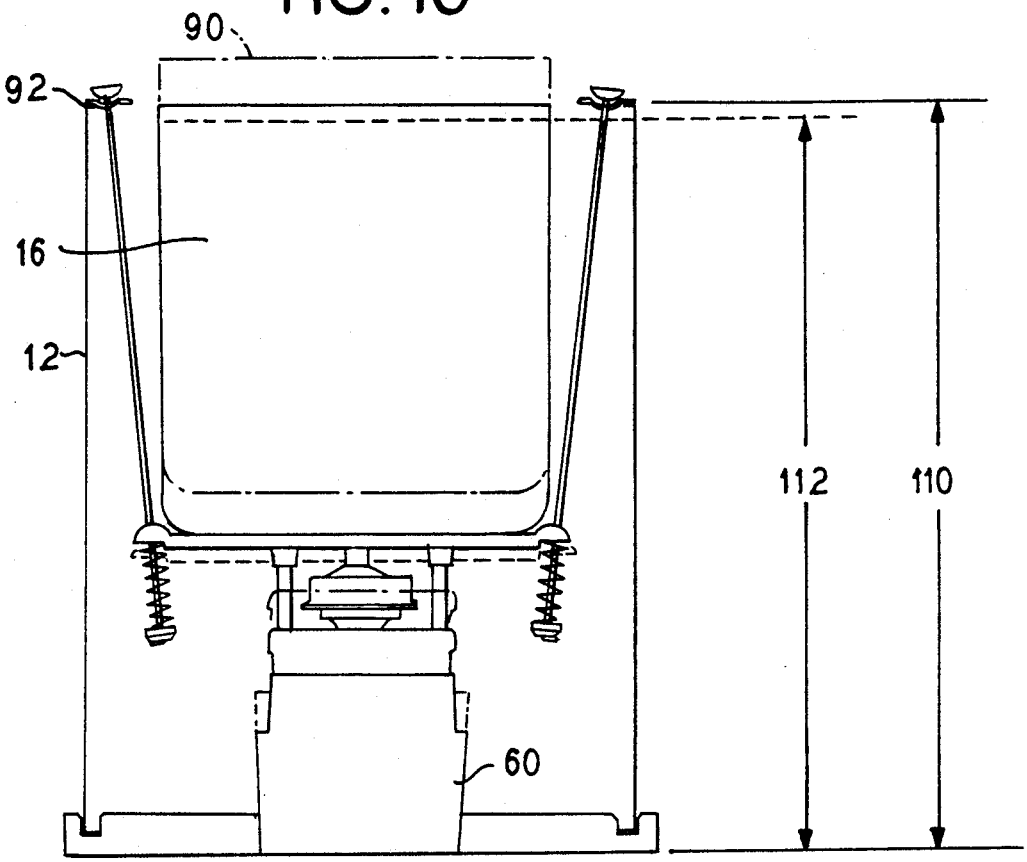
FIG. 10 is a sectional schematic view illustrating the elevated position of the wash tub and drive assembly and main support of FIG. 5 in dash-dot lines, a supported position of the wash tub and drive assembly in full lines and a loaded, unsupported position of the wash tub and drive assembly in dashed lines.

Thus, after the wash tub and drive assembly 14 has been turned over and is supported on the main base 60 as shown in FIG. 8, the cabinet support members are placed around the main support 60 as best seen in FIG. 3 and the washer cabinet 12 is placed over the entire assembly to be received in the grooves 84 as shown by the phantom lines in FIG. 3. At this point the suspension system 30 is attached only to the wash tub and drive assembly 14 and not to the cabinet 12. Upper ends 88 of the rods 32 are loosely held to the tub 16 so that they remain in a generally vertical orientation. At this step in the manufacturing process a device is operated to vertically move the main support 60 upwardly thus lifting the wash tub and drive assembly 14 relative to the cabinet 12. This is illustrated in FIGS. 5 and 10 (dash-dot lines) where it is seen that the tub 16 is elevated such that a top end 90 thereof projects above a top end 92 of the cabinet 12. The loosely connected rods 32 may then be manipulated so that the top ends 88 may be guided into openings 94 formed in sockets 96 formed in each of the corners of the cabinet 12. (FIG. 7) While the tub and drive assembly 14 is raised, suspension balls 98 are attached to the top ends 88 of each rod 32. The main support 60 is then lowered causing the balls 98 to be seated in the sockets 96 (FIG. 6).

The full weight of the wash tub and drive assembly 14 is not transferred to the cabinet 12 at this time however. A height of the sidewalls 74 of the main support is selected such that the tub and drive assembly will be maintained at a height 110 (FIG. 10) above a predetermined rest or loaded height 112 (dashed lines) of the tub assembly without the main support 60 installed. Thus, the suspension system and cabinet are at least partially unloaded of the weight of the tub assembly, and the tub support 60 carries the weight instead.

The main support 60 has recesses 120 which engage with protrusions 122 on the cabinet supports 80 to assure that the main support 60 will be precisely held in a fixed horizontal position relative to the cabinet support so that no shifting of the tub and drive assembly 14 will occur relative to the cabinet 12. Since the tub 60 and cabinet 80 supports are located below the tub assembly and cabinet, they absorb vertically-directed shocks which would otherwise be transferred to the washer. Thus, the washer and cabinet are protected against damage during transport.

Figure 11:
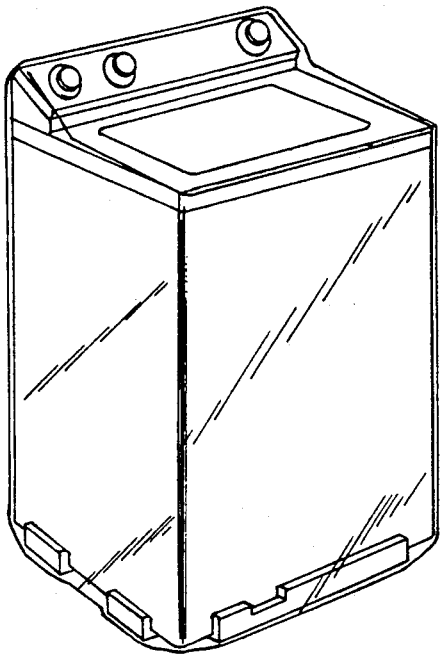
FIG. 11 is a perspective view of the appliance of FIG. 1 with a shrink wrap shipping film applied.
Figure 12:
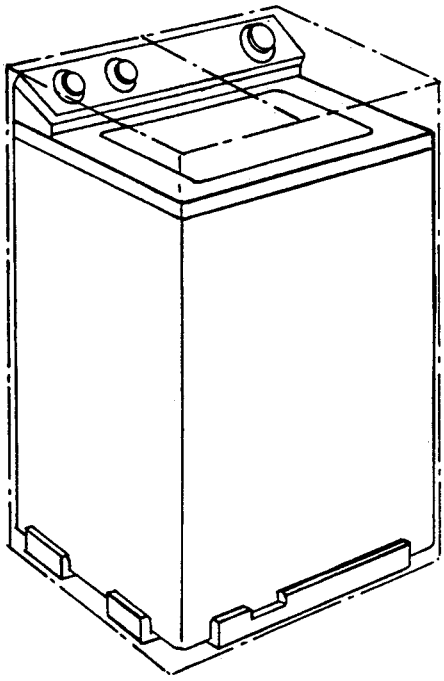
FIG. 12 is a perspective view of the appliance of FIG. 1 with a carton shipping container applied.

The fixture 50 ca be utilized with various types of external packaging material such as shrink wrap packaging as illustrated in FIG. 11 or a cardboard type carton as illustrated in FIG. 12. Once the washer arrives at its final destination at a user's home, the fixture 50 may be removed and discarded along with the external packaging materials.

As is apparent from the foregoing specification, the invention is susceptible of being embodied with various alterations and modifications which ma differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A fixture for use in manufacturing and transporting an appliance having an exterior cabinet with an interior assembly connected to the cabinet by means of a suspension system comprising:

an interior assembly support member;

said interior assembly support member being fictionally engageable with said interior assembly;

at least one cabinet support member separate from said interior assembly support member;

said cabinet support member being fictionally engageable with said cabinet and engaging said interior assembly support member to prevent horizontal movement between said interior assembly and cabinet members, yet permitting vertical movement therebetween upon relative vertical movement between said interior assembly support member and said cabinet support member, wherein said interior assembly support member and cabinet support member are constructed of a semi-rigid shock absorbing material comprising an expanded foam material.

2. A fixture for sue in manufacturing and transporting an appliance having an exterior cabinet with an interior assembly connected to the cabinet by means of a suspension system comprising:

an interior assembly support member;

said interior assembly support member being fictionally engageable with said interior assembly;

at least one cabinet support member separate from said interior assembly support member;

said cabinet support member being fictionally engageable with said cabinet and engaging said interior assembly support member to prevent horizontal movement between said interior assembly and cabinet members, yet permitting vertical movement therebetween upon relative vertical movement between said interior assembly support member and said cabinet support member, wherein two separate cabinet support members are utilized which surround at least a portion of said interior assembly support member.

3. A fixture according to claim 2, wherein said interior assembly support member encloses an area within said cabinet and wherein said interior assembly has at least one movable part in said enclosed area and said interior assembly support member is cut away at the area of said movable part to permit movement of said part while said interior assembly support member is engaged on said interior assembly.

4. A fixture according to claim 2, wherein said interior assembly support member has a vertical dimension sufficient to cause at least a partial support of the weight of the interior assembly during final assembly and shipping of the appliance.

5. A fixture as claimed in claim 2 for use during the manufacturing process of said appliance in a coordinate system consisting of perpendicular horizontal X and vertical Y axes which intersect at an origin, where said X axis has a positive direction and a negative direction on opposite sides of said origin, and a conveyor means for moving said appliance along said X axis, said conveyor means having a maximum acceleration A in the positive or negative direction of said X axis, where said appliance has a mass M, and a weight W defined by the equation $W=M * G$, where G is the acceleration due to gravity, and where the center of mass of said appliance is raised by said interior assembly support member to a height H along said Y axis above said origin, wherein a dimension D of said interior assembly support member extending from said origin in said positive and said negative directions of said X axis corresponds to the following formula to prevent tipping of said appliance in response to acceleration of said conveyor means: $D>=(M\times A\times H\times 2)/W$.

6. A fixture for use in manufacturing and transporting an appliance having an exterior cabinet with an interior assembly connected to the cabinet by means of a suspension system comprising:

an interior assembly support member;

said interior assembly support member being fictionally engageable with said interior assembly;

at least one cabinet support member separate from said interior assembly support member;

said cabinet support member being fictionally engageable with said cabinet and engaging said interior assembly support member to prevent horizontal movement between said interior assembly and cabinet members, yet permitting vertical movement therebetween upon relative vertical movement between said interior assembly support member and said cabinet support member, wherein said cabinet support member has a groove in a top surface thereof for frictionally receiving a bottom edge of said cabinet.

7. A method for assembling and transporting an appliance comprising:

assembling an interior portion of said appliance in an inverted position;

attaching an interior portion support member to said interior portion in said inverted position;

inverting said interior portion of said appliance to an upright position with said interior portion support member supporting the weight of said interior portion in said upright position;

positioning a cabinet support member in at least partial surrounding relationship with said interior portion support member;

assembling an outer cabinet around said interior portion to rest upon said cabinet support member;

raising said interior portion support member and said interior portion relative to said cabinet and cabinet support member;

attaching a suspension system between said interior portion and said cabinet;

lowering said interior portion support member and said interior portion relative to said cabinet and said cabinet support member;

continuing to support a portion of the weight of said interior portion by said interior portion support member for the remainder of said assembly method and during shipping of said appliance.

8. A method according to claim 7, further including the step of operating said appliance while said interior portion is supported by said interior portion support member.

9. A fixture for use in manufacturing and transporting an appliance having an exterior cabinet, an interior assembly and a suspension system operative to transfer the weight of said interior assembly to said cabinet, said fixture comprising:

an interior assembly support member removeably attached to said interior assembly for carrying at least a portion of the weight of said interior assembly and at least partially unloading said cabinet and suspension system;

at least one cabinet support member separate from said interior assembly support member removeably attached to said cabinet for carrying at least a portion of the weight of said cabinet;

said interior assembly support member including a horizontal platform having engagement means formed thereon for forming an interference fit with at least a portion of said interior assembly and securing said interior support member thereto, and a plurality of vertical sidewalls depending from said platform for supporting said platform; and said cabinet support member having a base surface with flange means formed thereon for receiving said cabinet, said base surface comprising an aperture therein for receiving said interior assembly support member therethrough, sand said cabinet support member being adapted to permit vertical displacement of said interior assembly support member relative to said cabinet support member during the assembly of said appliance.

10. A fixture for use in manufacturing and transporting an appliance having an exterior cabinet, an interior assembly and a suspension system operative to transfer the weight of said interior assembly to said cabinet, said fixture comprising:

an interior assembly support member removeably attached to said interior assembly for carrying at least a portion of the weight of said interior assembly and at least partially unloading said cabinet and suspension system;

at least one cabinet support member separate from said interior assembly support member removeably attached to said cabinet for carrying at least a portion of the weight of said cabinet;

said cabinet support member comprising first and second lateral support members disposed on opposite sides of said interior assembly support member.

11. A fixture as claimed in claim 10 wherein said interior assembly support member and said cabinet support member are constructed of expanded polystyrene.

12. A fixture as claimed in claim 10 for use during the manufacturing process of said appliance in a coordinate system consisting of perpendicular horizontal X and vertical Y axes which intersect at an origin, where said X axis has a positive direction and a negative direction on opposite sides of said origin, and a conveyor means for moving said appliance along said X axis, said conveyor means having a maximum acceleration A in the positive or negative direction of said X axis, where said appliance has a mass M, and a weight W defined by the equation $W=M*G$, where G is the acceleration due to gravity, and where the center of mass of said appliance is raised by said interior assembly support member to a height H along said Y axis above said origin, wherein a dimension D of said interior assembly support member extending from said origin in said positive and said negative directions of said X axis corresponds to the following formula to prevent tipping of said appliance in response to acceleration of said conveyor means: $D>=(M\times A\times H\times 2)/W$.

13. A fixture as claimed in claim 9, wherein:

said interior assembly support member said interior assembly support member being adapted to support said interior assembly to absorb vertically directed shocks to prevent damage to said interior assembly and to said suspension means; and said cabinet support member being adapted to absorb vertically directed shocks to prevent damage to said cabinet and to said suspension means, said cabinet support means further comprises means for preventing horizontal displacement of said interior assembly support member relative to said cabinet support means, thereby preventing contact between said interior assembly and said cabinet.

14. A fixture for use in manufacturing and transporting an appliance having an exterior cabinet, an interior assembly and a suspension system operative to transfer the weight of said interior assembly to said cabinet, said fixture comprising:

an interior assembly support member removeably attached to said interior assembly for carrying at least a portion of the weight of said interior assembly and at least partially unloading said cabinet and suspension system;

at least one cabinet support member separate from said interior assembly support member removeably attached to said cabinet for carrying at least a portion of the weight of said cabinet;

wherein said interior assembly includes at least one mechanical component attached thereto which moves during operation, and said interior assembly support member comprises a cutaway portion in the vicinity of said mechanical component to permit operation of said appliance with said interior assembly support member attached to said interior assembly.

15. A fixture as claimed in claim 14 wherein said interior assembly support member comprises a drain aperture therethrough for permitting drainage of liquids from said fixture resulting from operation of said appliance.

16. A method of manufacturing an appliance having an outer cabinet, an inner suspended member, a resilient suspension means for transferring the weight of said suspended member to said cabinet, said suspension means having a first portion connected to said suspended member and a second portion connected to said cabinet, said suspension means adapted for supporting said suspended member at a predetermined loaded height relative to said cabinet when transferring the weight of said suspended member to said cabinet, and main support means and cabinet support means for supporting said appliance during assembly, with said manufacturing method comprising the following steps:

assembling said inner suspended member with said first portion of said suspension means attached thereto;

applying said main support to said suspended member, and placing said cabinet support means adjacent to said main support means;

installing said cabinet around said suspended member and said main support means, with said cabinet supported by said cabinet support means;

elevating said suspended member with said main support means attached thereto to a elevated height relative to said cabinet, where said elevated height is above said loaded height, and connecting said second portion of said suspension means to said cabinet;

lowering said suspended member and said main support means from said elevated height to an intermediate height, where said intermediate height is above said loaded height, such that said suspended member is at least partially supported by said main support means, thereby at least partially unloading said cabinet and suspension means; and supporting said cabinet by said cabinet support means.

17. The method of manufacturing as claimed in claim 16, wherein said suspension means comprises a rod having a first end connected to a coil spring at said first portion of said suspension means, and a second end connected to a ball at said second portion of said suspension means, and said cabinet comprises a socket with an aperture therein, wherein said manufacturing method comprises the following steps:

directing said second end of said rod through said socket aperture while said suspended member and said main support means are in said elevated position;

installing said ball on said second end of said rod; and lowering said suspended member and said main support means to said intermediate position such that said ball is disposed in said cabinet socket.

18. The method of manufacturing as claimed in claim 16 wherein said suspended member comprises a top portion and a bottom portion, with said manufacturing method comprising the additional steps of:

assembling said suspended member in an inverted orientation with said bottom portion facing upwards;

applying said main support means to said upwardly facing bottom portion of said suspended means; and inverting said suspended member such that said top portion is facing upwards and said main support means acts as a support beneath said bottom portion of said suspended member.

19. The method of manufacturing as claimed in claim 16 comprising the additional steps of:

applying a carton around the outside of said manufactured appliance.

20. The method of manufacturing as claimed in claim 16 comprising the additional step of:

applying a shrinkable film around the outside of said manufactured appliance; and shrinking said film to adhere to said manufactured appliance.

21. A shippable appliance assembly comprising:

an appliance having an outer cabinet, an inner suspended member, and a resilient suspension means connected between said cabinet and said suspended member for transferring the weight of said suspended member to said cabinet, said suspension means further being adapted to support said suspended member at a predetermined loaded height relative to said cabinet while transferring the weight thereof to said cabinet;

a support means removably disposed beneath said cabinet and said suspended member, said support means being dimensioned so as to support said suspended member at a raised height above said loaded height to at least partially reduce the load carried by said suspension means and said cabinet, and to absorb vertically directed shocks to prevent damage to said appliance assembly.

22. The shippable appliance assembly as claimed in claim 21 wherein said support means is constructed from expanded polystyrene.

23. The shippable appliance assembly as claimed in claim 21 further comprising a carton surrounding said cabinet and said support means for containing said appliance and preventing damage thereto.

24. The shippable appliance assembly as claimed in claim 21 wherein said support means comprises:

a main support body removably attached beneath said suspended member; and a cabinet support body removably disposed adjacent to said main support body beneath said cabinet, said cabinet support body adapted to prevent movement of said main support body relative to said cabinet support body in a horizontal direction, thereby preventing contact between said suspended member and said cabinet which may damage said appliance.

25. The shippable appliance assembly as claimed in claim 24, wherein said appliance comprises an automatic washer, and said suspended member comprises an automatic washer tub assembly having at least one movable mechanical component attached thereto, wherein said main support body comprises a cutaway portion in the vicinity of said mechanical component to permit operation of said automatic washer with said main support body attached thereto.

26. The shippable appliance assembly as claimed in claim 21 further comprising an outer layer of shrink film surrounding said cabinet and said support mean for containing said appliance and preventing damage thereto.

* * * * *